United States Patent [19]

Desjardin

[11] Patent Number: 5,065,977

[45] Date of Patent: Nov. 19, 1991

[54] INTEGRAL TOOL AND CLIP FOR VERTICAL SUPPORT IN A CONTAINER

[76] Inventor: Warren Desjardin, 18 Bonita Rd., East Quogue, N.Y. 11942

[21] Appl. No.: 557,659

[22] Filed: Jul. 25, 1990

[51] Int. Cl.[5] ..... A47B 91/00

[52] U.S. Cl. ..... 248/692; 15/236.08; 248/113

[58] Field of Search ..... 248/110, 113, 217.3, 248/909, 692; 211/65, 66; 220/85 D, 85 R; 215/100 R; 24/3 L, 563, 555; 15/236.01, 236.07, 236.08, 159 R, 143 R, 246

[56] References Cited

U.S. PATENT DOCUMENTS

| | | | |
|---|---|---|---|
| 2,262,538 | 11/1941 | Olson et al. | 220/85 D |
| 2,544,310 | 3/1951 | Gerhan | 15/236.08 |
| 2,643,046 | 6/1953 | Humphreys | 248/110 |
| 2,938,224 | 5/1960 | Foulkes | 248/113 X |
| 3,231, 919 | 2/1966 | MacDonald | 248/692 X |
| 3,274,684 | 9/1966 | Marks | 15/236.08 X |
| 3,275,187 | 9/1966 | Lamoureaux | 15/236.01 X |
| 3,408,677 | 11/1968 | Yates | 15/236 R |
| 4,200,948 | 5/1980 | Nesseth | 15/236.08 |
| 4,770,712 | 9/1988 | Hopkins | 15/236.08 X |
| 4,832,293 | 5/1989 | Gizzi | 248/110 |

*Primary Examiner*—Carl D. Friedman
*Assistant Examiner*—Daniel Hulseberg
*Attorney, Agent, or Firm*—Richard L. Miller

[57] ABSTRACT

A clip for holding a tool in a container in a vertical position is provided and consists of a structure formed in the flat heel portion between the flat handle portion and the flat blade portion of a substantially one piece construction of the tool. The structure will attach the tool to an open annular rim of the container so that the tool will be held in the vertical position within the container, while maintaining the handle in a convenient position for the user to grasp.

9 Claims, 1 Drawing Sheet

INTEGRAL TOOL AND CLIP FOR VERTICAL SUPPORT IN A CONTAINER

BACKGROUND OF THE INVENTION

The instant invention relates generally to fasteners and more specifically it relates to a clip for holding a tool in a container in a vertical position.

Numerous fasteners have been provided in the prior art that are adapted to clasp or hold various objects and parts together. While these units may be suitable for the particular purpose to which they address, they would not be as suitable for the purpose of the present invention as hereafter described.

SUMMARY OF THE INVENTION

A primary object of the present invention is to provide a clip for holding a tool in a container in a vertical position that will overcome the shortcomings of the prior art devices.

Another object is to provide a clip for holding a tool in a container in a vertical position in which the clip is a flexible tongue and a pair of notched shoulders formed out of the tool between the handle and blade thereof.

An additional object is to provide a clip for holding a tool in a container in a vertical position in which the flexible tongue and the pair of notched shoulders can attach the tool to the inner lip on the open rim of the container.

A further object is to provide a clip for holding a tool in a container in a vertical position that is simple and easy to use.

A still further object is to provide a clip for holding a toll in a container in a vertical position that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
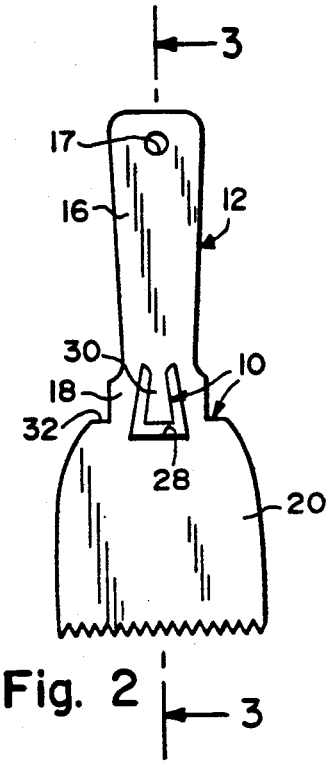
FIG. 2 is a plan view of the invention per se taken in the direction of arrow 2 in FIG. 1.
Figure 3:
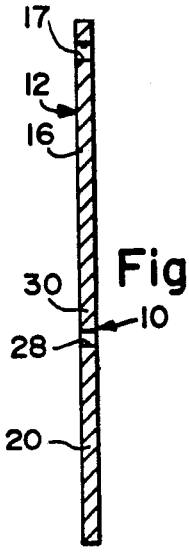
FIG. 3 is a cross sectional view taken on line 3—3 of FIG. 2.
Figure 4:
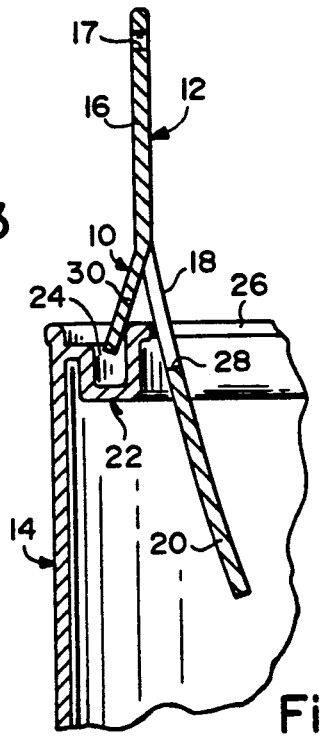
FIG. 4 is a cross sectional view taken on line 4—4 of FIG. 1.
Figure 1:
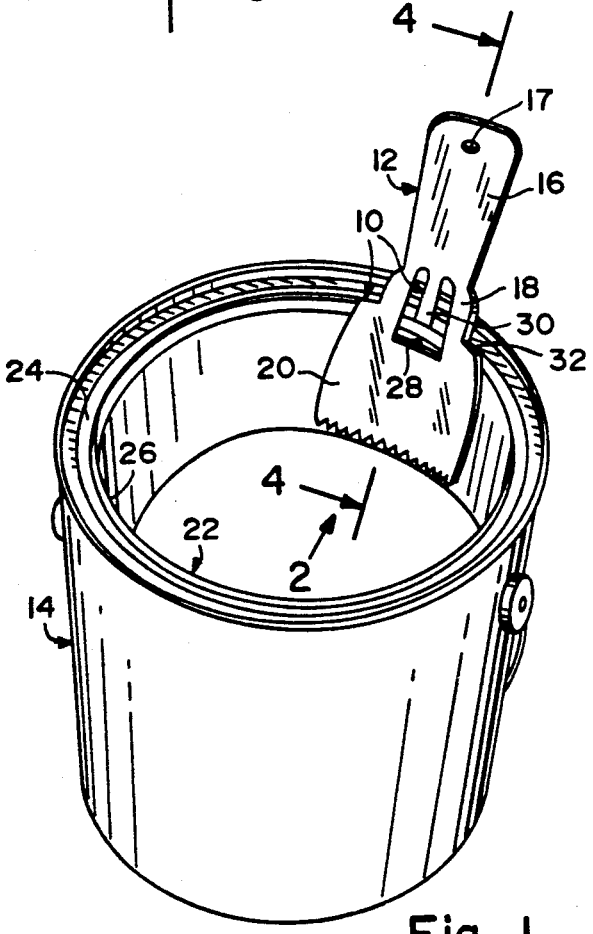
FIG. 1 is a perspective view of a container, such as a can, illustrating the invention attached thereto.
Figure 5:
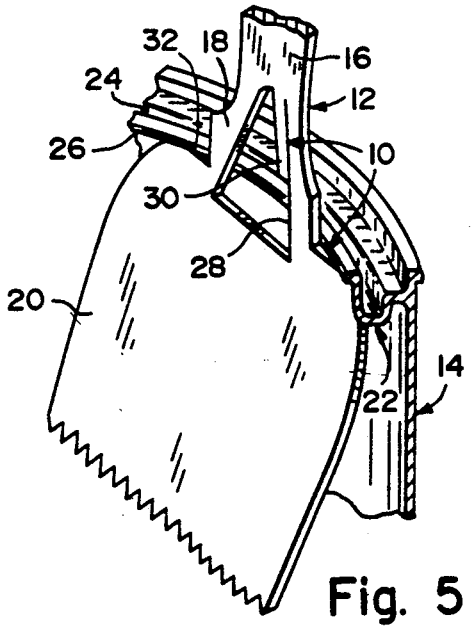
FIG. 5 is an enlarged perspective view showing in greater detail how the instant invention attaches to the inner lip on the open rim of the container.

Turning now descriptively to the drawings, in which like reference characters denote like elements throughout the several views, the Figures illustrate a clip 10 for holding a tool 12 in a container 14 in a vertical position. The tool 12 is of a substantially one piece construction having a flat handle portion 16 with a hanging hole 17 and a flat heel portion 18 terminating in a flat blade portion 20. The tool 12 can be a simple putty knife, adhesive spreader or the like. The container 14, such as a putty can, paint can, etc., is of the type having an open annular rim 22 with an annular groove 24 and an inner annular lip 26 thereon.

The invention which is the clip 10 is formed in the flat heel portion 18 for attaching the tool 12 to the open annular rim 22 so that the tool 12 be held in the vertical position within the container 14. The flat heel portion 18 of the tool 12 has a tapered U-shaped aperture 28 therethrough so as to form a flexible tapered tongue 30 therein and a pair of notched shoulders 32. The tongue 30 can be flexed to enter the annular groove 24 in the open annular rim 22, with the notched shoulder 32 in engagement with the bottom of the inner annular lip 26 holding the tool 12 in the vertical position within the container 14.

The tool 12 with the clip 10 can be fabricated out of a thin durable plastic, metal or wooden material. In fact, almost any type of a thin durable material can be utilized in fabricating the tool 21 with the clip 10.

To use the invention a person simply presses the tongue 30 and inserts it into the annular groove 24 so that the notched shoulders 32 will engage the bottom of the inner annular lip 26 to hold the tool 12 in the vertical position within the container 14. This will temporarily store the tool 12 in the container 14 and allow any putty adhesive or other materials on the flat blade 20 to drop back into the container 14, with the tool handle maintained in a readily convenient position for the user to grasp when needed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A one-piece, uniplanar tool for securing to the rim of an open mouthed container of the type having an annular rim with an upwardly opening annular groove and an annular, inwardly extending lip, the tool comprising an upper, flat handle portion connected to a lower, flat blade portion by a flat heel portion and a flat, resiliently flexible tongue having an upper, root end integral with the heel portion, and a lower, downwardly facing, groove engaging free end, a pair of upwardly facing, lip engaging shoulders spaced apart from respective opposite sides of the tongue defined by notches formed in respective opposite side edges of the tool at a location between the blade portion and the handle so that the tongue can be flexed with the groove engaging end received in the groove to engage the shoulders under the inwardly extending annular lip thereby clipping the tool onto the rim with the blade portion extending vertically into the container.

2. A tool according to claim 1 wherein the shoulders are located at a junction of the heel portion and the blade portion.

3. A tool as recited in claim 1 in which the tongue is defined by a tapered, U-shaped aperture in the heel portion.

4. A clip as recited in claim 1, wherein said clip is fabricated out of a thin plastic material.

5. A clip as recited in claim 1, wherein said clip is fabricated out of a thin metal material.

6. A clip as recited in claim 1, wherein said clip is fabricated out of a thin wooden material.

7. In combination, a one-piece, uniplanar tool and an open mouthed container of the type having an annular rim with an upwardly opening annular groove and an annular, inwardly extending lip the tool comprising an upper, flat handle portion connected to a lower, flat blade portion by a flat heel portion and a flat, resiliently flexible tongue having an upper, root end integral with the heel portion, and a lower, downwardly facing, groove engaging free end, a pair of upwardly facing, lip engaging shoulders spaced apart from respective opposite sides of the tongue defined by notches formed in respective opposite side edges of the tool at a location between the blade portion and the handle so that the tongue can be flexed with the groove engaging end received in the groove to engage the shoulders under the inwardly extending annular lip thereby clipping the tool onto the rim with the blade portion extending vertically into the container.

8. The combination as recited in claim 7, wherein the shoulders are located at a junction of the heel portion and the blade portion.

9. The combination recited in claim 7, wherein the tongue is defined by a tapered, U-shaped aperture in the heel portion.

* * * * *